US005995059A

United States Patent [19]

Shoemaker

[11] Patent Number: 5,995,059

[45] **Date of Patent: *Nov. 30, 1999**

[54] COAXIAL ANTENNAS WITH UNGROUNDED OUTER CONDUCTOR SECTION

[75] Inventor: Kevin O. Shoemaker, Lafayette, Colo.

[73] Assignee: Antennas America, Inc., Wheat Ridge, Colo.

[ * ] Notice: This patent is subject to a terminal disclaimer.

[21] Appl. No.: 09/052,524

[22] Filed: Mar. 30, 1998

Related U.S. Application Data

[63] Continuation-in-part of application No. 08/672,400, Jun. 10, 1996, Pat. No. 5,793,336.

[51] Int. Cl.[6] ..... H01Q 9/04

[52] U.S. Cl. ..... 343/790; 343/791

[58] Field of Search ..... 343/790, 791, 343/792, 793, 715, 900, 903; H01Q 9/04

[56] References Cited

U.S. PATENT DOCUMENTS

| | | | |
|---|---|---|---|
| 2,486,597 | 11/1949 | Greene | 343/791 |
| 3,031,668 | 4/1962 | Bryson | 343/790 |
| 3,139,620 | 6/1964 | Leidy et al. . | |
| 3,315,264 | 4/1967 | Brueckmann | 343/791 |
| 4,543,583 | 9/1985 | Wurdack . | |
| 5,252,984 | 10/1993 | Dorrie et al. | 343/791 |
| 5,793,336 | 8/1998 | Shoemaker et al. | 343/795 |

FOREIGN PATENT DOCUMENTS

| | | |
|---|---|---|
| 26 36 523 | 2/1978 | Germany . |

*Primary Examiner*—Hoanganh Le
*Attorney, Agent, or Firm*—Ancel W. Lewis, Jr.

[57] ABSTRACT

A stable coaxial antenna for broad band and narrow band applications is described. The antenna disclosed is preferably made of a conventional coaxial cable having a center conductor, tubular outer conductor surrounding the center conductor and an insulator between the conductors. A gap is formed in at least the outer conductor to form two outer conductor sections. In a first embodiment the field is provided between the gap and a feed end. In a second embodiment the gap is between both center and outer conductors and the ends of the conductors in the gap are cross connected to form a radiating section and feed section. The coaxial antennas disclosed may be adjusted to synchronize the energy to react favorably to an uncontrolled environment.

11 Claims, 5 Drawing Sheets

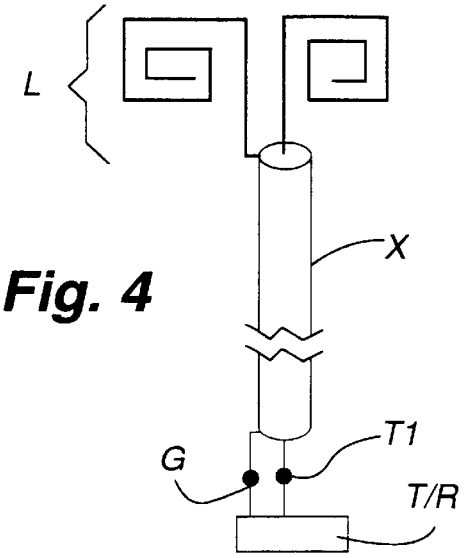
Fig. 4
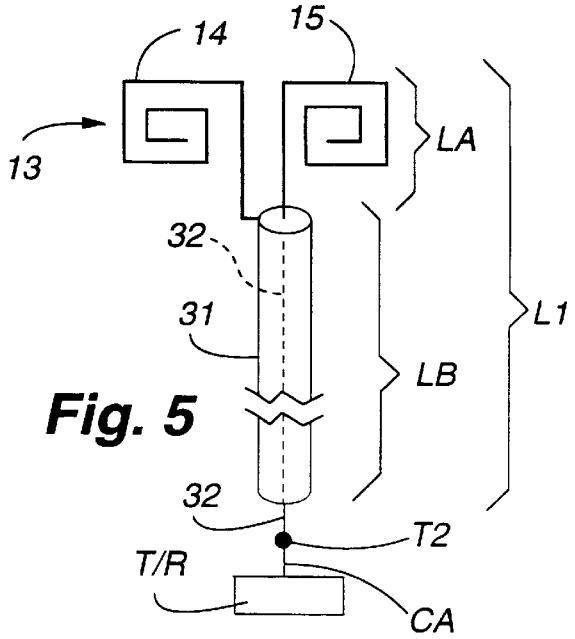
Fig. 5
Fig. 6A
Fig. 6B
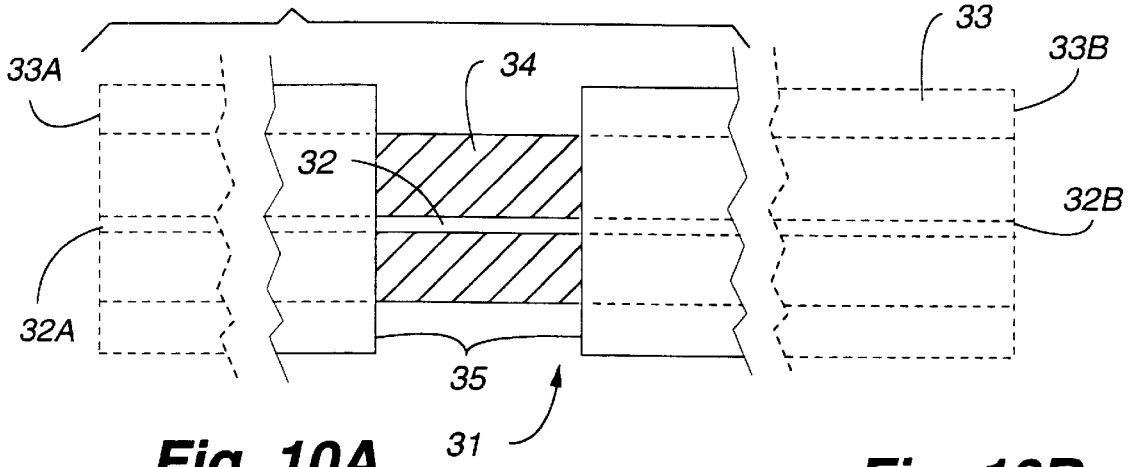
Fig. 10A
Fig. 10B
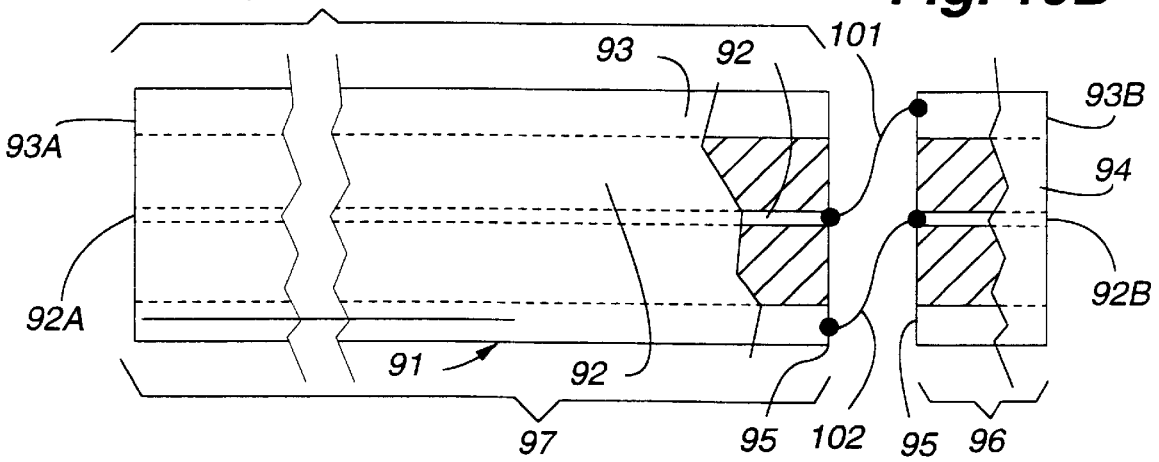

C
35
33
31
35

C
93B
92B
96
95
FC
91
97
93A
92A

C
95

C
95

COAXIAL ANTENNAS WITH UNGROUNDED OUTER CONDUCTOR SECTION

This is a continuation-in-part of application Ser. No. 672,400 filed Jun. 10, 1996, now U.S. Pat. No. 5,793,336.

TECHNICAL FIELD

This invention relates to antennas and more particularly to a coaxial antenna that is readily modified to respond to the peculiarities of the environment in which the antenna is used.

BACKGROUND ART

Typically, an antenna is designed to operate in an open environment whereby its radiating elements, commonly known as aerials, conduct energy by which radio waves are sent out or received as a link between free-space and the transmit or receiving system. Antennas respond to a field and develop voltage across two antenna terminals proportionate to the length of the antenna. The electric fields are typically parallel to the radiating elements and the magnetic fields are typically perpendicular to the radiating elements. Polarization is generally related to the position of the electric field. With conventional antenna elements, a coaxial cable is used to transfer the energy from the transmit or receiving source. Cables are made so that the cable is not mismatched to the antenna causing currents to flow down the outside of the shield thereby disturbing the operation and ultimately inhibiting the performance of the antenna element.

German Patent No. 2,636,523 discloses a coaxial cable which also acts as a radiator of high frequency electromagnetic waves.

Wurdack No. 4,543,583 discloses a dipole antenna that has the jacket removed from a central portion to expose the outer conductor that is spread apart to form a gap exposing the dielectric layer.

Leidy No. 3,139,620 discloses a coaxial multiband antenna.

DISCLOSURE OF THE INVENTION

A coaxial antenna disclosed has a center conductor for carrying signals, a tubular outer conductor or shield surrounding the center conductor providing a radiator sensitive to a select band of frequencies and an insulator between the center and outer conductors for isolating the center conductor from the outer conductor. In one embodiment a gap is provided in only the outer conductor and in the other embodiment the gap is in both the center conductor and outer conductor to form a radiating section and a feed section with reverse electric connections between adjacent center and outer conductors in the gap. The gap is at any position along the antenna and multiple gaps may be used.

In an environment that is unpredictable or unreliable a coaxial antenna according to the present invention provides a diverse antenna system whereby the antenna element can be used as a radiating element and to synchronize the energy so the antenna may better react to an uncontrolled environment.

The coaxial antenna according to the present invention manages the flow of energy creating a virtual antenna and, by using a gapping process that includes the length of the gap, placement and critical termination points, radiates as a primary or secondary antenna source.

BRIEF DESCRIPTION OF THE DRAWINGS

Details of this invention are described in connection with the accompanying drawings which like parts bear similar reference numerals in which:

FIG. 4 is a schematic diagram of a prior art antenna with the typical coaxial cable-antenna connection.

FIG. 5 is a schematic diagram of an antenna connection embodying features of the present invention.

FIG. 6A is an enlarged view of the first end shown in FIG. 6.

FIG. 6B is an enlarged view of the second end shown in FIG. 6.

FIG. 10A is an enlarged view of the first end of the coaxial antenna shown in FIG. 10.

FIG. 10B is an enlarged view of the second end of the coaxial antenna shown in FIG. 10.

DETAILED DESCRIPTION

Figure 1:
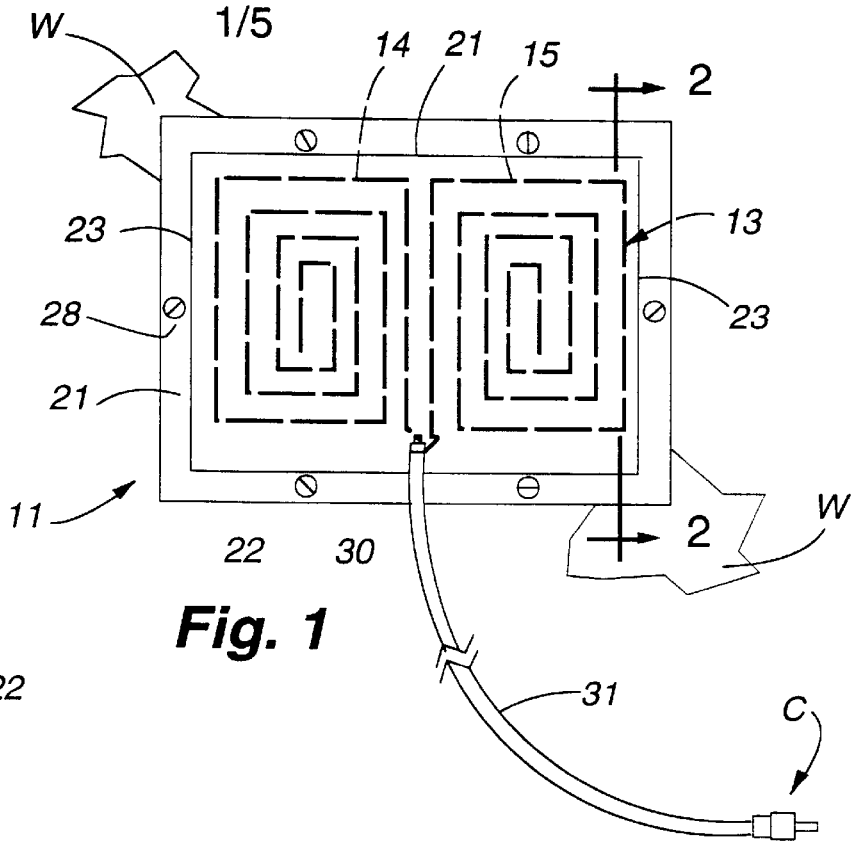
FIG. 1 is a rear elevation view of a first embodiment of a conformal antenna assembly embodying features of the present invention shown mounted on a flat, vertical wall.

The antenna shown is a planar, serpentine type of the type shown in U.S. Pat. No. 5,363,114 and the disclosure of which is incorporated into the disclosure of this application by reference. The antenna assembly 11 shown in FIGS. 1–3 has a flat, rectangular-shaped, non-conductive (insulator) inner carrier layer 12, preferably of styrofoam plastic, on which there is mounted a first active antenna portion 13 including a first radiator 14 (strip conductor) in a serpentine pattern and a second radiator 15 (strip conductor) in a serpentine pattern. Each radiator has a feed end and an open end and a series of change of direction points along the length thereof with each change of direction point forming an electric discontinuity to provide more than one connected radiator section. The sections are perpendicular to one another to radiate energy in an omnidirectional pattern so that the currents in alignment with the E vector are those corresponding to horizontal and vertical polarizations as described in U.S. Pat. No. 5,363,114. A non-conductive (insulator) spacer layer 16, preferably of styrofoam plastic, is disposed against the radiator so the radiators are sandwiched between layer 12 and layer 16 to form an antenna sandwich.

The housing 18 shown is rectangular-shaped and has a flat front wall 19 and a straight top wall 21, a straight bottom wall 22 and a pair of opposed straight side walls 23 projecting away from the edges of the front wall 19. A back cover wall 25 fits inside walls 21 and 22 to enclose the antenna sandwich. A mounting flange 27 extends transverse or perpendicular to the outer edge of each of walls 21, 22 and 23 and has holes 28 to provide a means for mounting the housing to a supporting surface such as that shown as a flat side wall W of a building. The front wall 19, top wall 21, bottom wall 22, side walls 23 and flange 27 are molded to form a one-piece, rigid, plastic body, preferably from a ABS plastic, and is an environmentally protective weather-resistant layer or radome for the antenna sandwich. Back cover wall 25 is made of the same material as walls 21, 22 and 23 but is a separate plate that conforms in shape to the shape of the inside of the area bounded by walls 21, 22 and 23. The side walls 23 are short in relation to the front and back walls so as to provide a relatively thin, low profile housing for containing the antenna sandwich.

The flange 27 has a planar or flat conformal back surface 29 that conforms to the shape of the flat exterior wall surface and in this form is a flat wall as above described. Fastening screws 30 are shown as extending through the holes 28 for mounting the antenna housing to the side wall W.

A cable 31 is connected at one end to the antenna radiators 13 and 14 and the other end has a conventional terminal connector C with a male plug at the end. The connector C may be a female connector. Cable 31 is a coaxial cable having a center conductor 32 and a tubular outer conductor 33 with an insulator 34 between the two conductors. Antenna radiator 13 connects at a feed end to one end of the center conductor 32 and antenna radiator 14 connects at a feed end to one end of the outer conductor 33. A portion of the outer conductor 33 at the terminal end at connector C is removed to form a gap 35 so that the outer conductor is ungrounded at the terminal end. The other end of the center conductor 32 connects at a terminal end to the male plug of the feed terminal connector C.

Referring now to FIG. 4 there is shown a schematic diagram of a prior art antenna having a typical coaxial cable-antenna connection in which the cable does not form a part of the active portion of the antenna. There is shown the active antenna portion having a length designated by L, a coaxial cable X with the center conductor having a feed terminal T1 and a ground terminal G connected to the end of the outer tubular portion of the coaxial cable. A transmitter/receiver TR is shown connected to terminals T1 and G.

According to the present invention the active antenna portion 13 has a length LA and the coaxial cable a length LB and the two lengths LA plus LB form the length of the antenna designated L1. This total length L1 for the present invention is 10 feet. The length LA of the first active antenna portion is particularly sensitive to the UHF frequencies of about 350 MHz to 900 MHz. The length of LB is particularly sensitive to the VHF frequencies of about 50 MHz to 350 MHz. There is some overlap in frequencies of each of these lengths LA and LB. In this way the conductors 32 and 33 of the cable 31 are used as a second active antenna portion in combination with the first active antenna portion and this arrangement has been found to pick up local stations for UHF/VHF signals. The terminal end T2 of the center conductor can be connected to a cable CA and/or to a transmitter/receiver TR.

Figure 2:
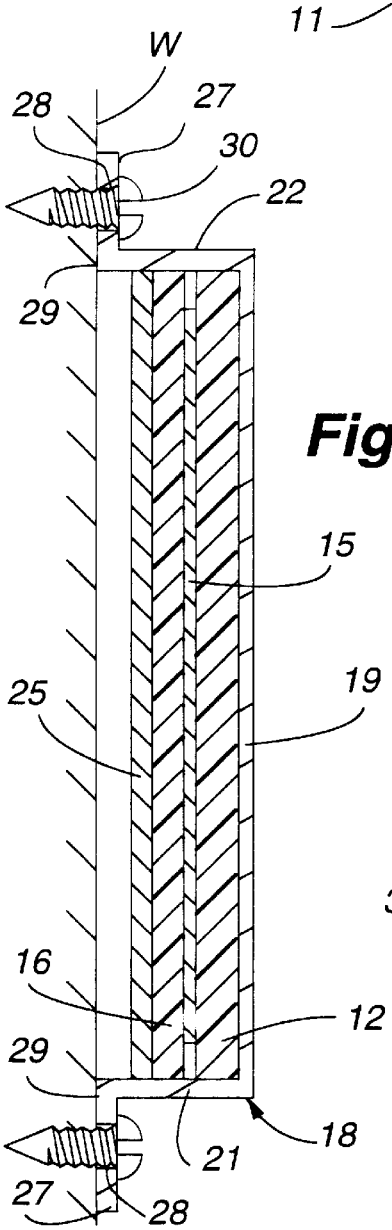
FIG. 2 is a sectional view taken along line 2—2 of FIG. 1.
Figure 3:
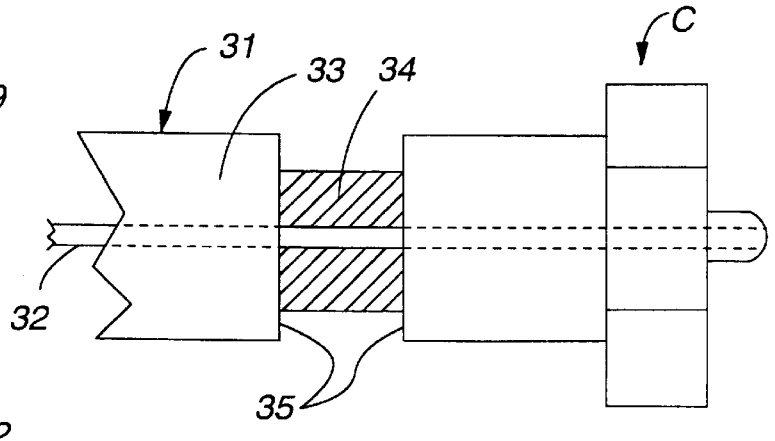
FIG. 3 is an enlarged elevation view of a coupling end of the cable shown in FIG. 2.
Figure 6:
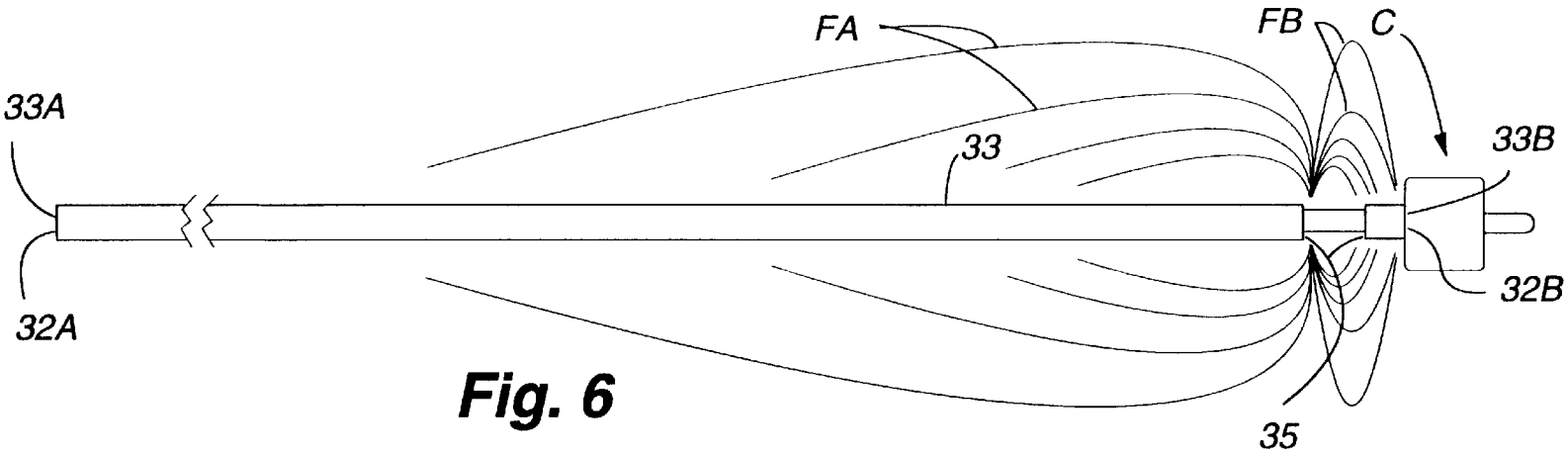
FIG. 6 is a side elevation view of a coaxial antenna similar to that shown in FIGS. 1–5 but with the first end unterminated and with electric field lines shown.
Figure 7:
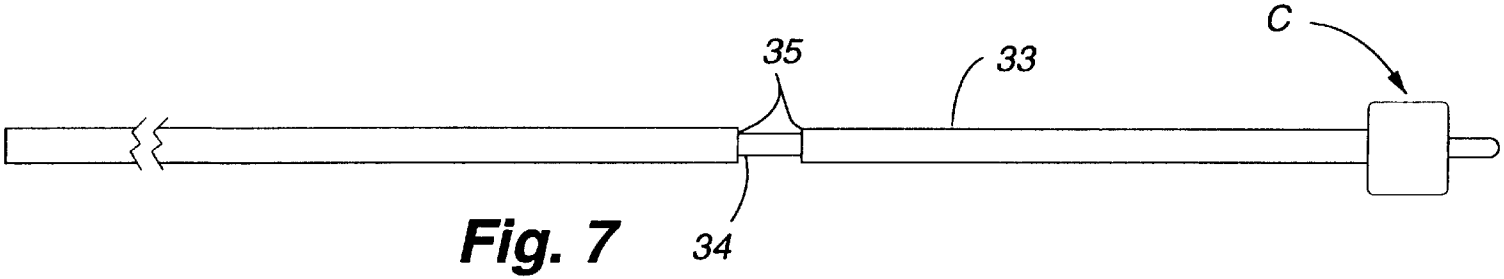
FIG. 7 is a side elevation view of a coaxial antenna similar to the antenna shown in FIG. 6 with the gap in an intermediate position.
Figure 8:
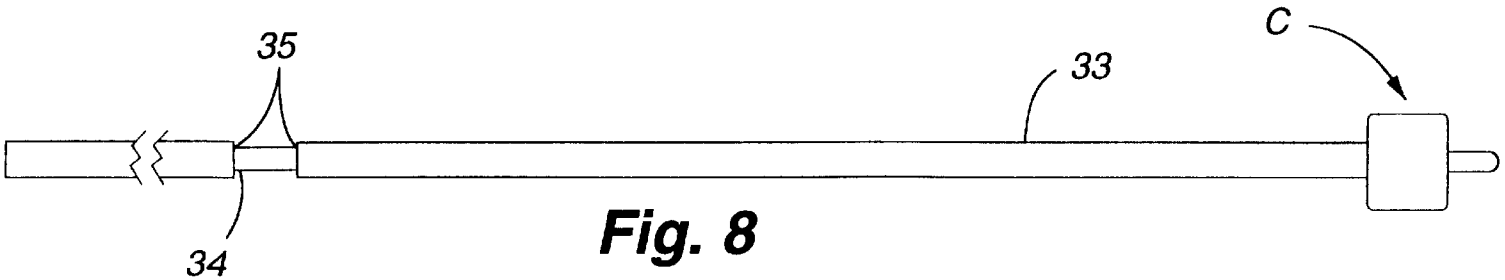
FIG. 8 is a side elevation view of a coaxial antenna similar to the antenna shown in FIG. 6 with the gap closer to the first end.

Referring now to FIGS. 6, 6A and 6B the coaxial antenna shown is similar to that of FIGS. 1 and 3. The antenna shown is preferably made of a conventional coaxial cable of a selected length. For reference purposes the center conductor 32 has a first end 32A and a second end 32B opposite the first end. The first end is a cut end and is herein also referred to as an unterminated end when not connected to another antenna as is illustrated in FIGS. 1–5. The tubular outer conductor or shield 33 surrounding the center conductor has a first end 33A and a second end 33B opposite the first end and the insulator 34 is between the center and outer conductors and extends the full length thereof. In this embodiment the gap 35 is a selected position between the first ends 32A, 33A and second ends 32B, 33B closer to the second ends to unground the outer conductor 33 and provide a first electric field FA between the gap 35 and the first ends 32A, 33A and the second electric field FB between the gap 35 and the second ends 32B, 33B during operation. FIG. 7 shows a gap 35 at an intermediate position between the first ends and second ends. FIG. 8 shows the gap 35 closer to the first ends and FIG. 9 shows two spaced gaps 35 at spaced positions between the first ends 32A, 33A and second ends 32B, 33B.

The length of the gap 35, the placement or location of the gap 35 between the ends; and the termination point of the outer conductor may be adjusted to favorably react to the environment in which the antenna 31 is used.

Figures 9, 10, 11, 12:
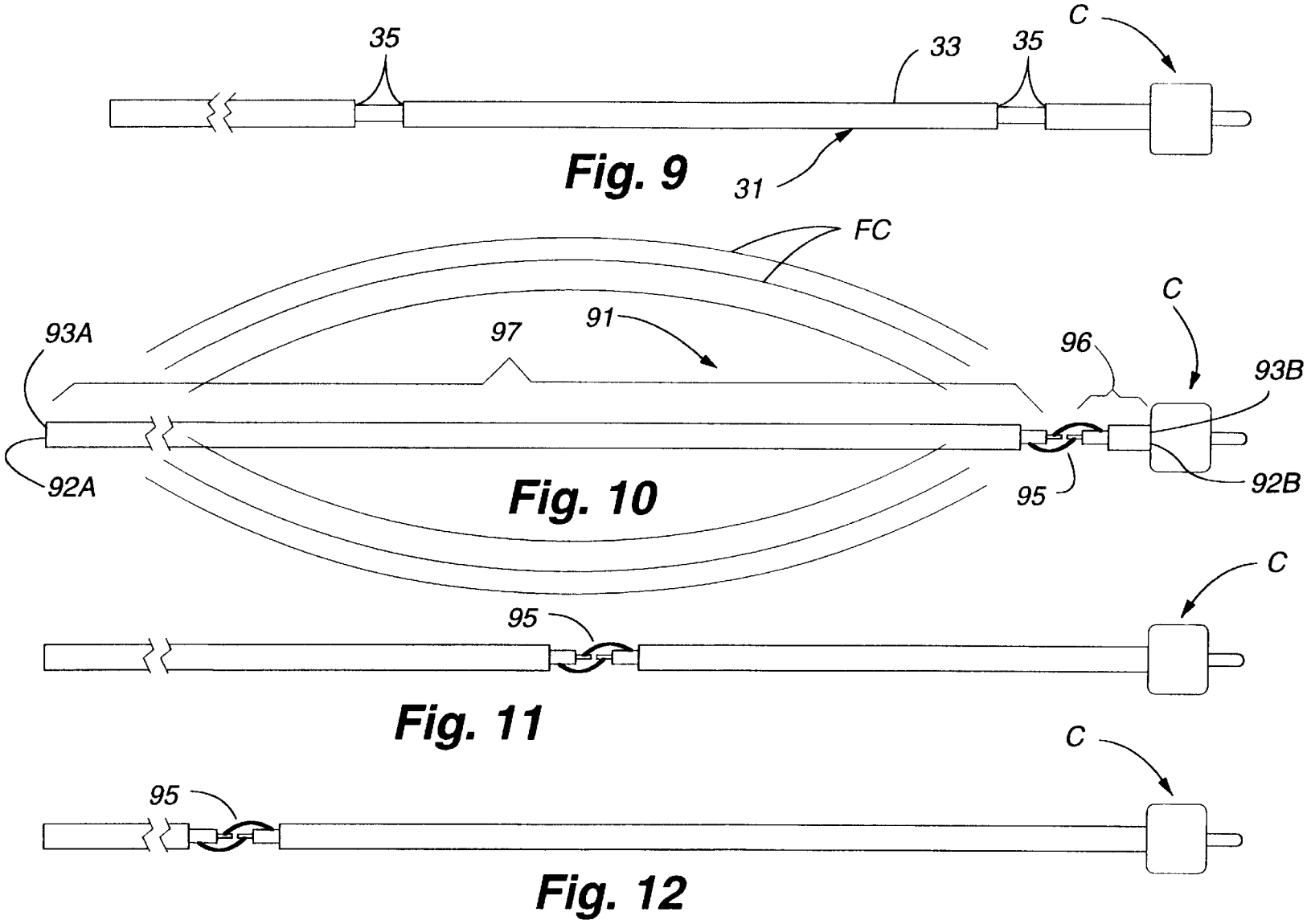
FIG. 9 is a coaxial antenna similar to the antenna shown in FIG. 6 having two spaced gaps.
FIG. 10 is a side elevation of a second embodiment of coaxial antenna with electric field lines shown and with the gap closer to the second end.
FIG. 11 is a side elevation view of a coaxial antenna similar to the antenna shown in FIG. 10 with the gap in an intermediate position.
FIG. 12 is a side elevation view of a coaxial antenna similar to the antenna shown in FIG. 10 with the gap closer to the first end.
Figure 13:
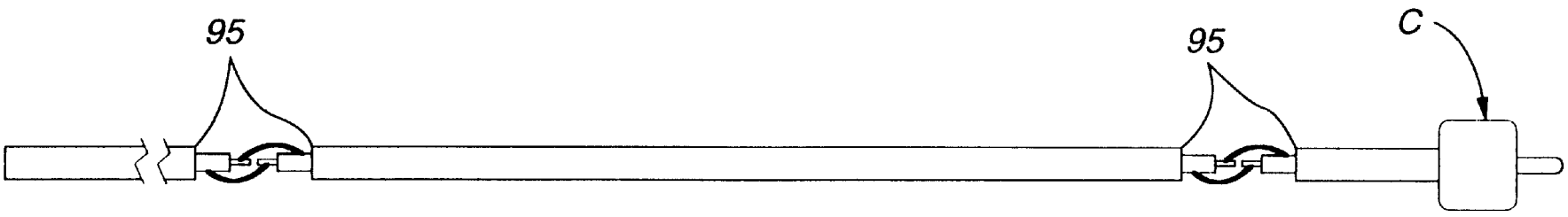
FIG. 13 is a side elevation view of a coaxial antenna similar to the antenna shown in FIG. 10 having two spaced gaps.

Referring now to FIGS. 10, 10A and 10B there is shown a second embodiment of a coaxial antenna 91 also preferably made of conventional coaxial cable of a selected length. This antenna 91 has a center conductor 92 having a first end 92A and a second end 92B opposite the first end, a tubular outer conductor or shield 93 surrounding and coaxial with the center conductor 92 having a first end 93A and a second end 93B, and an insulator 94 between the center and outer conductors. The first end 92A is a cut end and is also herein referred to as an unterminated end. In this embodiment the center conductor 92, outer conductor 93 and insulator have a gap 95 between the associated first ends 92A, 93A and second ends 92B, 93B to form a feed section 96 and a radiating section 97. The center conductor 92 and the tubular outer conductor 93 are reversely electrically connected in the gap 95 at adjacent ends. Specifically, an end of the center conductor of said radiating section 97 at the gap is electrically connected to an end of said tubular conductor of the feed section 96 at the gap 95 by line 101. An end of said outer conductor of said radiating section 97 at the gap 95 is connected to an end of center conductor of the feed section 96 at the gap by line 102. This arrangement provides an electric field FC between the gap and the first end 93A of the outer conductor of the radiating section 97 during operation. In FIG. 9 the gap is closer to the second or feed end. FIG. 11 shows the gap 95 at an intermediate position between the ends, FIG. 12 shows the gap 95 closer to the first end and FIG. 13 shows a length of coaxial cable with two gaps 95 at selected spaced positions along the cable.

Figure 14:
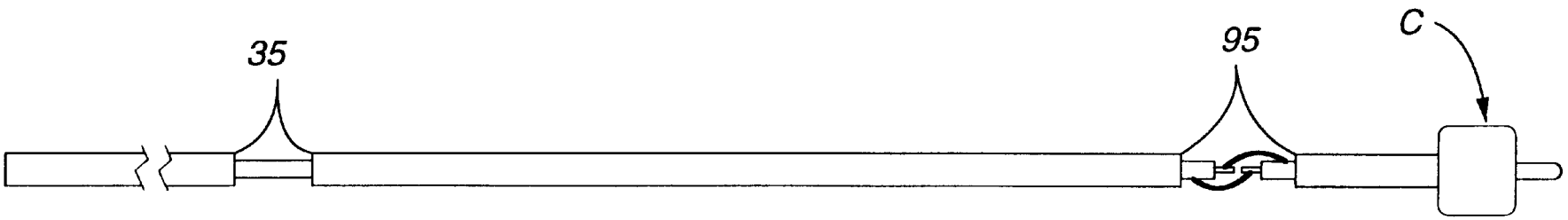
FIG. 14 is a side elevation view of an other embodiment of coaxial antenna having both types of gaps.

In yet a further embodiment shown in FIG. 14 there is shown a length of cable with a first gap 35 and a second gap 95 to combine the features above discussed in the embodiment shown in FIGS. 6 and 10.

The length of gap 95, the placement or location of the gap 95 between the ends and the termination point of the outer conductor may be adjusted to favorably react to the environment in which antenna 91 is used. This embodiment provides a flow of energy creating a virtual antenna.

Antenna 95 is a variation of a conventional collinear array antenna. The notable feature of the collinear array antenna is that it is made up of a multiple of one half wave length elements. Each element adds its power to the rest of the array to produce a high gain antenna with a narrow beam. Antenna 95 is similar but provides a single element to produce a low gain omnidirectional antenna. The position of the gap or center conductor/outer conductor reversal and the length of the outer conductor control the (VSWR) or match and the resonant frequency. This gap or reversal can be placed after any length of feed coaxial cable. Normally the length of the outer conductor after the reversal is on the order of one half wave length. However, it has been found that the environment in which the antenna is placed in loads the antenna this resonant section can be shortened to improve operation.

Antenna 95 operates on a slightly different principal than antenna 31 where fields are produced to perform the antenna operation. In both embodiments the typical length of the outer conductor is one half wave length. The radiation patterns or gain are very similar in both embodiments. The outer conductor in either embodiment can be either solid or a braided shield material. The shield does not always have to be copper but can be any electrically conductive material. The ratio of the length of the center conductor to the length of the outer conductor is important for VSWR considerations. The impedance can be controlled and adjusted. Most antenna systems are typically either 50 or 75 ohm impedances. The 75 ohm impedances are used in cable systems or local television reception antennas and 50 ohm impedances are used by two way cellular and laboratory systems. Other impedances, as for example 300 ohm, can be constructed by keeping the ratio of the lengths of the center to the length of the outer conductor compliant to certain formulas.

The coaxial antenna of the present invention may be made in a variety of forms which include 1) reversing the outer conductor and center conductor of a cable or portion of a cable, 2) placing a gap or multiple gaps in the cable, 3) combination of gap and outer conductor reversal and 4) mismatching an antenna to create surface affects. The variables in the design include the type of coaxial cable, location of the gap, location of the outer conductor reversal, length of coaxial cable, impedance of coaxial cable and termination of coaxial cable. The termination of the cable means both ends. The type of a connector is important at one end. Another antenna may be added to the first end as shown in the embodiment of FIGS. 1–5 or the end may be left unterminated. The coaxial antenna is a broad band antenna for use in television reception and may also be used for narrow band applications. In both cases the coaxial antennas of the present invention have been shown to have good radiating and good matching properties. There are simple manufacturing techniques and once the design is complete the antenna does not require further tuning. The coaxial antenna disclosed is applicable to situations where the environment changes. Most other antennas detune in proximity to other objects, especially conductive objects. For instance, an antenna inside a car causes detuning and therefore lowers sensitivity. Placing an antenna in or around the house causes similar problems. The present invention provides a very stable antenna for such applications and can be installed in a variety of locations.

Although the present invention has been described with a certain degree of particularity, it is understood that the present disclosure has been made by way of example and that changes in details of structure may be made without departing from the spirit thereof.

What is claimed is:

1. A coaxial antenna comprising:

center conductor for carrying electric signals, said center conductor having a radiating end and a feed end opposite said radiating end, a tubular outer conductor surrounding and coaxial with said center conductor for providing a radiator sensitive to a selected band of frequencies, said outer conductor having a radiating end and a feed end, an insulator between said center and outer conductors for isolating said center conductor from said outer conductor, and a gap of a selected length and at a selected position between said radiating end and said feed end of said outer conductor to electrically separate said outer conductor into first and second outer conductor sections, said outer conductor being ungrounded to provide a first electric field between said gap and said radiating end of said outer conductor and a second electric field between said gap and said feed end of said outer conductor during operation.

2. The coaxial antenna as set forth in claim 1 wherein said gap is closer to said radiating ends.

3. The coaxial antenna as set forth in claim 1 wherein said gap is closer to said feed ends.

4. The coaxial antenna as set forth in claim 1 wherein there is a plurality of spaced gaps.

5. The coaxial antenna as set forth in claim 1 wherein said conductors and insulator are made from a coaxial cable of a selected length.

6. The coaxial antenna as set forth in claim 1 wherein said radiating end is an unterminated end and said feed end is a feed end having a feed connector.

7. The coaxial antenna as set forth in claim 1 wherein the length of the outer conductor is selected to provide a radiating element having a half wave length.

8. The coaxial antenna as set forth in claim 1 wherein the length of said gap, the position of said gap between said ends and termination of said radiating end are selected to favorably react to the environment.

9. The coaxial antenna as set forth in claim 1 wherein there is a first gap of a preselected length and a second gap of a preselected length, said first gap being in said outer conductor only and said second gap being in both of said outer and center conductors.

10. A coaxial antenna comprising:

a coaxial cable of a selected length having a center conductor for carrying electric signals, said center conductor having a radiating end and a feed end opposite said radiating end, a tubular outer conductor surrounding said center conductor for providing a radiator sensitive to a selected band of frequencies, said outer conductor having a radiating end and a feed end, an insulator between said center and outer conductors for isolating said center conductor from said outer conductor, and a gap of a selected length at a selected position along said cable to electrically separate said outer conductor into first and second outer conductor sections, said outer conductor being ungrounded to provide a first electric field between said gap and said radiating end of said outer conductor and a second electric field between said gap and said feed end of said outer conductor during operation.

11. A coaxial antenna comprising:

a coaxial cable of a selected length having a center conductor for carrying electric signals, said center conductor having a radiating end and a feed end opposite said radiating end, a tubular outer conductor surrounding said center conductor for providing a radiator sensitive to a selected band of frequencies, said outer conductor having a radiating end and a feed end, an insulator between said center and outer conductors for isolating said center conductor from said outer conductor, and a gap at a selected position along said cable to electrically separate said outer conductor into an outer conductor feed section and an outer conductor radiating section, said gap also being in said center conductor to separate said center conductor into a center conductor feed section and a center conductor radiating section, an end of said center conductor radiating section at said gap being connected to an end of said outer conductor feed section at said gap and an end of said outer conductor radiator section at said gap being connected to an end of center conductor section at said gap to provide an electric field between said gap and said radiating end of said outer conductor radiating section during operation, said radiating outer conductor section ungrounded to provide an electric field between said gap and said radiating end of said outer conductor during operation.

* * * * *